US006573440B1

(12) United States Patent
Rodriguez

(10) Patent No.: US 6,573,440 B1
(45) Date of Patent: Jun. 3, 2003

(54) CAPO DEVICE FOR A STRINGED INSTRUMENT

(76) Inventor: Joe R. Rodriguez, 10606 San Gabriel Ave., South Gate, CA (US) 90280

( * ) Notice: Subject to any disclaimer, the term of this patent is extended or adjusted under 35 U.S.C. 154(b) by 0 days.

(21) Appl. No.: 10/047,406

(22) Filed: Jan. 16, 2002

(51) Int. Cl.[7] ..... G10D 3/00
(52) U.S. Cl. ..... 84/318; 84/316
(58) Field of Search ..... 84/318, 315, 316

(56) References Cited

U.S. PATENT DOCUMENTS 4,104,947 A * 8/1978 Oster ..... 84/318
4,250,790 A * 2/1981 Shubb et al. ..... 84/318

* cited by examiner

*Primary Examiner*—Kim Lockett

(57) ABSTRACT

A capo device for a stringed instrument for quickly and effectively clamping strings to the fingerboard of a stringed instrument. The capo device for a stringed instrument includes a frame capable of extending about a fingerboard of a stringed instrument; and also includes an assembly for clamping strings to the fingerboard of the stringed instrument; all features not described nor suggested by the prior art.

2 Claims, 4 Drawing Sheets

CAPO DEVICE FOR A STRINGED INSTRUMENT

BACKGROUND OF THE INVENTION

1. Field of the Invention

The present invention relates to guitar string clamps and more particularly pertains to a new capo device for a stringed instrument for quickly and effectively clamping strings to the fingerboard of a stringed instrument.

2. Description of the Prior Art

The use of guitar string clamps is known in the prior art. More specifically, guitar string clamps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,792,969; U.S. Pat. No. 5,492,045; U.S. Pat. No. 4,324,165; U.S. Pat. No. 4,250,790; U.S. Pat. No. 4,104,947; and U.S. Pat. No. Des. 257,988. None of the prior art allows the user to essentially clip the capo device to the fingerboard of the stringed instrument unlike the present invention.

While these devices fulfill their respective, particular objectives and requirements, the aforementioned patents do not disclose a new capo device for a stringed instrument. The inventive device includes a frame capable of extending about a fingerboard of a stringed instrument; and also includes an assembly for clamping strings to the fingerboard of the stringed instrument; all features not described nor suggested by the prior art.

In these respects, the capo device for a stringed instrument according to the present invention substantially departs from the conventional concepts and designs of the prior art, and in so doing provides an apparatus primarily developed for the purpose of quickly and effectively clamping strings to the fingerboard of a stringed instrument.

SUMMARY OF THE INVENTION

The general purpose of the present invention, which will be described subsequently in greater detail, is to provide a new capo device for a stringed instrument which has many of the advantages of the guitar string clamps mentioned heretofore and many novel features that result in a new capo device for a stringed instrument which is not anticipated, rendered obvious, suggested, or even implied by any of the prior art guitar string clamps, either alone or in any combination thereof.

There has thus been outlined, rather broadly, the more important features of the capo device for a stringed instrument in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new capo device for a stringed instrument which has many of the advantages of the guitar string clamps mentioned heretofore and many novel features that result in a new capo device for a stringed instrument which is not anticipated, rendered obvious, suggested, or even implied by any of the prior art guitar string clamps, either alone or in any combination thereof.

Still another object of the present invention is to provide a new capo device for a stringed instrument for quickly and effectively clamping strings to the fingerboard of a stringed instrument.

Still yet another object of the present invention is to provide a new capo device for a stringed instrument that is easy and convenient to set up and use.

Even still another object of the present invention is to provide a new capo device for a stringed instrument that allows the user to quickly attach and detach the capo device to the fingerboard.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
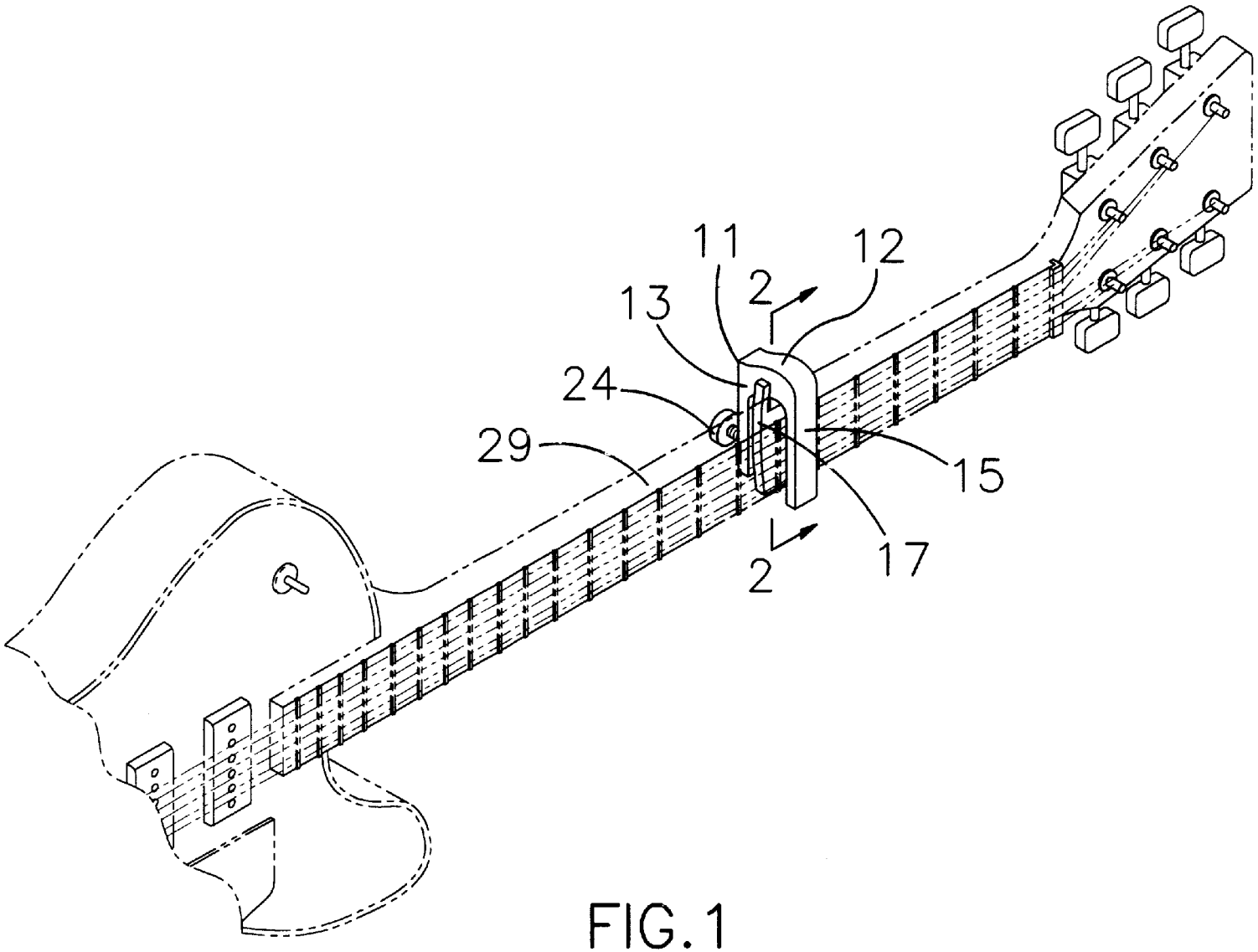
FIG. 1 is a perspective view of a new capo device for a stringed instrument according to the present invention and shown in use.
Figure 2:
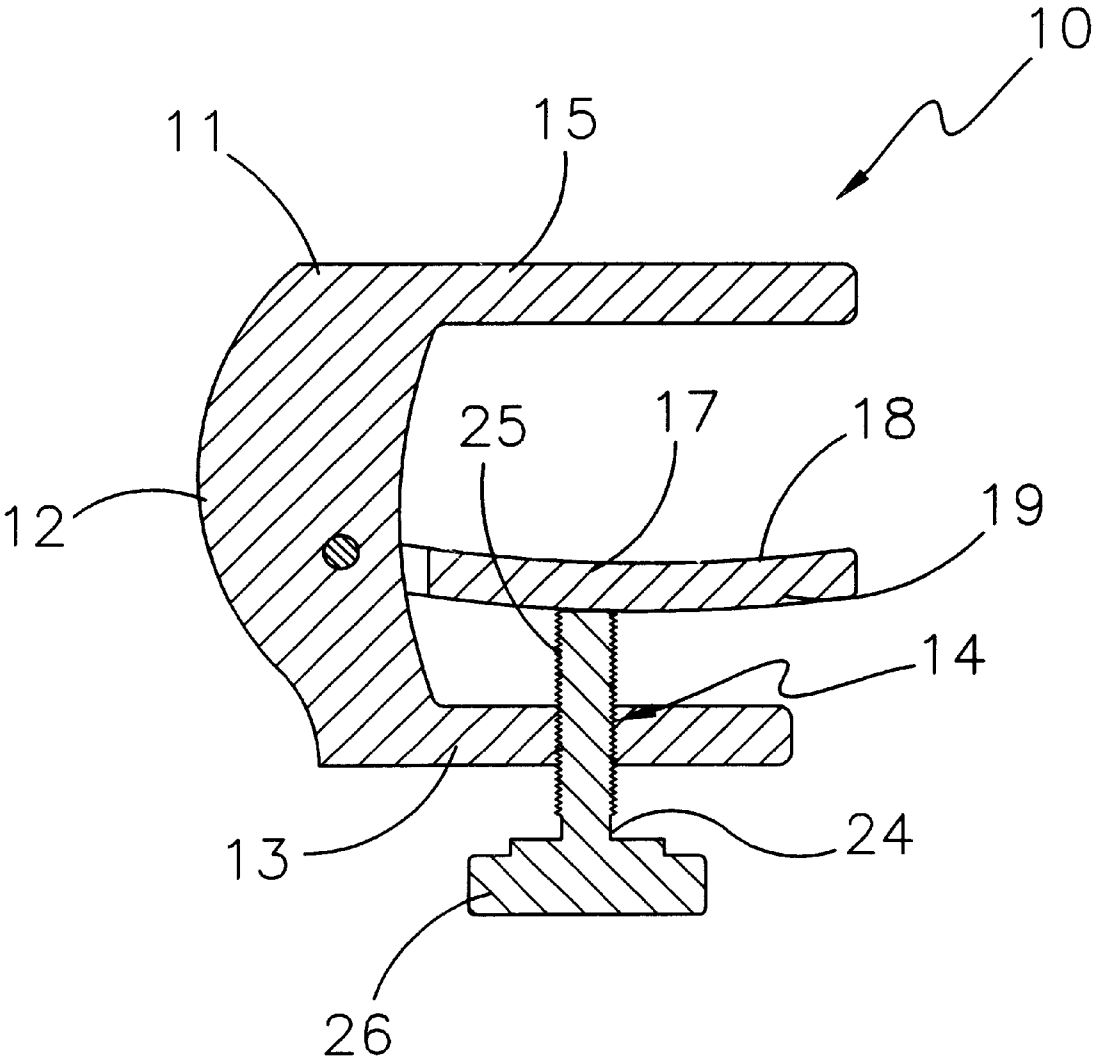
FIG. 2 is a cross-sectional view of the present invention.
Figure 3:
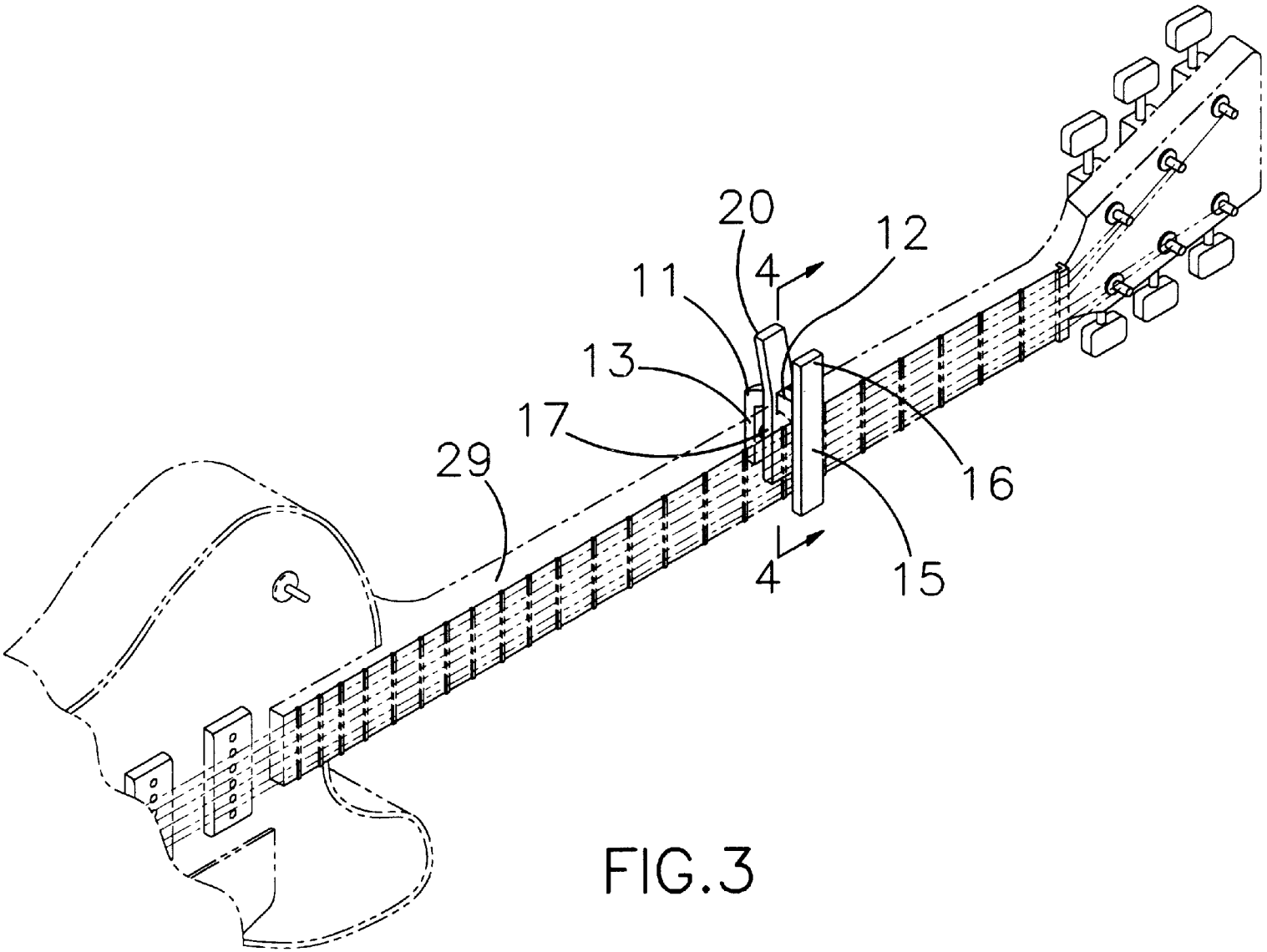
FIG. 3 is a perspective view of a second embodiment of the present invention.
Figure 4:
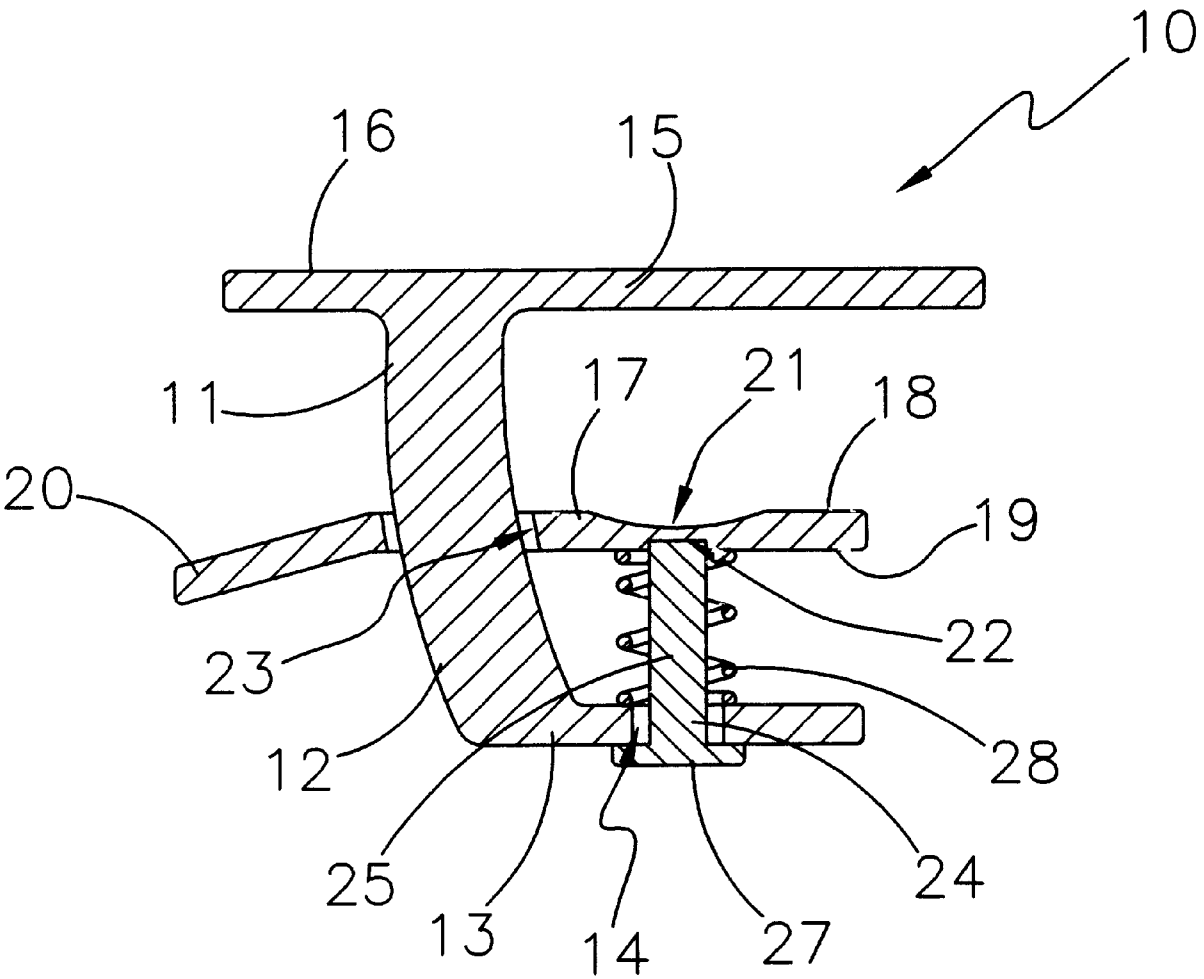
FIG. 4 is a cross-sectional view of the second embodiment of the present invention.

With reference now to the drawings, and in particular to FIGS. 1 through 4 thereof, a new capo device for a stringed instrument embodying the principles and concepts of the present invention and generally designated by the reference numeral 10 will be described.

As best illustrated in FIGS. 1 through 4, the capo device for a stringed instrument 10 generally comprises a frame 11 capable of extending about a fingerboard 29 of a stringed instrument. The frame 11 includes an elongate main body 12, and also includes a first arm 13 being integrally and conventionally attached to the elongate main body 12, and further includes a second arm 15 also being integrally and conventionally attached to the elongate main body 12. The first and second arms 13,15 are spaced apart and are essentially disposed perpendicular to the elongate main body 12.

The first arm 13 further includes an opening 14 being laterally extended through a medial portion of the first arm 13. The second and first arms 13,15 have ends which are integrally and conventionally attached to the elongate main body 12.

A means for clamping strings 30 to the fingerboard 29 of the stringed instrument includes a lever 17 being movably disposed between the first and second arms 13,15 and being pivotally attached to a medial portion of the elongate main body 12, and also includes a drive member 24 being threaded through the opening 14 of the first arm 13 and being engagable to the lever 17 for tightening the capo device 10 about the fingerboard 29. The lever 17 has an end which is pivotally attached with a fastener to the medial portion of the elongate main body 12 with the lever 17 being curved with a front side 18 thereof facing the second arm 15 and with a back side 19 thereof facing the first arm 13 and with the front side 18 of the lever 17 being adapted to engage the fingerboard 29. The drive member 24 includes a threaded shaft 25 and a knob 26 being integrally and conventionally attached at an end of the shaft 25.

As a second embodiment, the elongate main body 12 is conventionally and integrally attached between a medial portion and an end of the second arm 15 with the second arm 15 having a handle portion 16 extending from the end and terminating at where the elongate main body 12 is attached thereto. The elongate main body 12 is also integrally and conventionally attached at an end of the first arm 13. Further, for the second embodiment, the means for clamping the capo device 10 to a fingerboard includes a lever 17 having a hole 23 being laterally extended through a medial portion thereof with the elongate body member 12 being disposed through the hole 23, and also includes a drive member 24 being disposed through the opening 14 of the first arm 13 and being biasedly urged against the lever 17, and further includes a spring member 28 being disposed about the drive member 24 for urging the drive member 24 against the lever 17 and forcing the lever 17 toward the second arm 15. The lever 17 also has a handle portion 20 integrally extending from an end thereof and terminating at the hole 23 for allowing a user to quickly clamp and unclamp the capo device 10 about the fingerboard 29. The lever 17 has a beveled depression 21 disposed in a front side 18 thereof with the front side 18 facing the second arm 15. The beveled depression 21 is disposed between the hole 23 and another end of the lever 17. The lever 17 also has a slot 22 being disposed in a back side 19 thereof with the slot 22 being disposed between the hole 23 and the another end of the lever 17. The drive member 24 has a shaft 25 about which the spring member 28 is disposed and also has a head portion 27 which is integrally and conventionally attached at an end of the shaft 25 with the shaft 25 having another end which is extended into the slot 22 of the lever 17.

In use, the user places the capo device 10 about the fingerboard 29 of the stringed instrument and engages the lever 17 to the fingerboard 29 by using the drive member 24 with the second arm 15 engaging the strings 30 of the stringed instrument to effect the type of sound the user is trying achieve from the stringed instrument.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the capo device for a stringed instrument. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A capo device for a stringed instrument comprising:

a frame capable of extending about a fingerboard of a stringed instrument, said frame including an elongate main body, and also including a first arm being attached to said elongate main body, and further including a second arm also being attached to said elongate main body, said first and second arms being spaced apart and are essentially disposed perpendicular to said elongate main body, said first arm further including an opening being laterally extended through a medial portion of said first arm, said elongate main body being attached between a medial portion and an end of said second arm with said second arm having a handle portion extending from said end and terminating at where said elongate main body is attached thereto, said elongate main body also being attached at an end of said first arm; and a means for clamping strings to the fingerboard of the stringed instrument including a lever having a hole being laterally extended through a medial portion thereof, said elongate body member being disposed through said hole, and also including a drive member being disposed through said opening of said first arm and being biasedly urged against said lever, and further including a spring member being disposed about said drive member for urging said drive member against said lever handle portion extending from an end thereof an terminating at said hole for allowing a user to quickly clamp and unclamp said capo device about the fingerboard, said lever having a beveled depression disposed in a front side thereof with said front side facing said second arm, said beveled depression being disposed between said hole and another end of said lever, said lever also having a slot disposed in a back side thereof, said slot being disposed between said hole and said another end of said lever.

2. A capo device for a stringed instrument comprising:

a frame capable of extending about a fingerboard of a stringed instrument, said frame including an elongate main body, and also including a first arm being attached to said elongate main body, and further including a second arm also being attached to said elongate main body, said first and second arms being spaced apart and are essentially disposed perpendicular to said elongate main body, said first arm further including an opening being laterally extended through a medial portion of said first arm, said elongate main body being attached between a medial portion and an end of said second arm with said second arm having a handle portion extending from said end and terminating at where said elongate main body is attached thereto, said elongate main body also being attached at an end of said first arm; and a means for clamping strings to the fingerboard of the stringed instrument including a lever having a hole being laterally extended through a medial portion thereof, said elongate body member being disposed through said hole, and also including a drive member being disposed through said opening of said first arm and being biasedly urged against said lever, and further including a spring member being disposed about said drive member for urging said drive member against said lever and forcing said lever toward said second arm, said lever also having a handle portion extending from an end thereof an terminating at said hole for allowing a user to quickly clamp and unclamp said capo device about the fingerboard, said drive member having a shaft about which said spring member is disposed and also having a head portion which is attached at an end of said shaft, said shaft having another end which is extended into said slot of said lever.

* * * * *